US007621283B2

(12) United States Patent
Zentner et al.

(10) Patent No.: US 7,621,283 B2
(45) Date of Patent: Nov. 24, 2009

(54) APPLIANCE METHODS AND APPARATUS

(75) Inventors: Martin Mitchell Zentner, Prospect, KY (US); James Alan Cosgrove, Lagrange, KY (US); Ronald Scott Tarr, Louisville, KY (US); Errin Whitney Gnadinger, Louisville, KY (US)

(73) Assignee: General Electric Company, Schenectady, NY (US)

( * ) Notice: Subject to any disclaimer, the term of this patent is extended or adjusted under 35 U.S.C. 154(b) by 307 days.

(21) Appl. No.: 10/750,460

(22) Filed: Dec. 31, 2003

(65) Prior Publication Data

US 2004/0261434 A1 Dec. 30, 2004

Related U.S. Application Data

(63) Continuation-in-part of application No. 10/609,960, filed on Jun. 30, 2003, now Pat. No. 6,912,870.

(51) Int. Cl.
*B08B 3/02* (2006.01)
*B08B 7/00* (2006.01)

(52) U.S. Cl. ..... 134/57 D; 134/58 D; 134/57 R; 134/113

(58) Field of Classification Search ..... 134/56 D, 134/57 D, 58 D, 113, 94.1, 18, 25.2, 25.3, 134/58 R, 109, 57 R
See application file for complete search history.

(56) References Cited

U.S. PATENT DOCUMENTS 4,097,307 A 6/1978 Geiger
4,120,032 A * 10/1978 Mirdadian ..... 702/46
4,178,957 A 12/1979 Hoffman et al.
RE30,478 E * 1/1981 Fraula et al. ..... 134/57 D
4,271,861 A 6/1981 Crawford
4,277,290 A * 7/1981 Andrews et al. ..... 134/10
4,408,640 A * 10/1983 Voza ..... 141/1
5,330,580 A * 7/1994 Whipple et al. ..... 134/18
5,408,716 A 4/1995 Dausch et al.
5,409,023 A 4/1995 Santarossa et al.
5,487,528 A 1/1996 Richmond
5,803,985 A 9/1998 Alvord
5,878,603 A * 3/1999 Warren et al. ..... 68/207
6,823,878 B1 * 11/2004 Gadini ..... 134/58 D
6,939,412 B2 * 9/2005 Slocum et al. ..... 134/18
2003/0034052 A1 2/2003 Kiesler et al.

FOREIGN PATENT DOCUMENTS

DE 4022439 1/1992
DE 4409641 9/1995
DE 4418721 11/1995
JP 06233737 A 8/1994
JP 09-327432 A2 12/1997
JP 10-094508 A 4/1998
JP 2001046298 A 2/2001
JP 2002306394 A 4/2001
JP 2001321316 A 11/2001

* cited by examiner

*Primary Examiner*—Michael Barr
*Assistant Examiner*—Saeed T Chaudhry
(74) *Attorney, Agent, or Firm*—George L. Rideout, Esq.; Armstrong Teasdale LLP

(57) ABSTRACT

A method includes using a turbine ratemeter in an appliance to meter delivery of a liquid.

11 Claims, 5 Drawing Sheets

APPLIANCE METHODS AND APPARATUS

CROSS REFERENCE TO RELATED APPLICATIONS

This application is a continuation-in-part application of U.S. application Ser. No. 10/609,960 filed Jun. 30, 2003, issued as U.S. Pat. No. 6,912,870 on Jul. 5, 2005, which is hereby incorporated by reference.

BACKGROUND OF THE INVENTION

This invention relates generally to appliances, and more specifically, to water delivery operations in appliances.

Water pressures in some communities and even within some neighborhoods may vary from 10 pounds per square inch (psi) to 150 psi. Therefore appliance water delivery operations (e.g., water fill to an ice maker, water delivery to a water dispenser, water fill in a dishwasher, and/or water fill in a washing machine) oftentimes use a self regulating flow washer which may create loud noise at pressures above about 45 psi.

BRIEF DESCRIPTION OF THE INVENTION

In one aspect, a method includes using a turbine ratemeter in an appliance to meter delivery of a liquid.

In another aspect, a method of operating a dishwasher is provided. The method includes sensing a current to a pump motor to detect a cavitation of the pump, and actuating a valve in response to detecting the cavitation.

In yet another aspect, a method of operating a dishwasher is provided. The method includes using a turbine ratemeter to deliver a first amount of water to the dishwasher for a first dishwashing cycle, monitoring at least one operation of the dishwasher during the first dishwashing cycle to detect an underfill condition, and using the turbine ratemeter to add additional water to the dishwasher upon detecting at least one underfill condition during the first dishwashing cycle. The method also includes retaining a first total amount of additional water added during the first dishwashing cycle, using the turbine ratemeter to deliver the first amount of water to the dishwasher for a second dishwashing cycle subsequent the first cycle, and monitoring at least one operation of the dishwasher during the second dishwashing cycle to detect an underfill condition. The method further includes using the turbine ratemeter to add additional water to the dishwasher upon detecting at least one underfill condition during the second dishwasher cycle, retaining a second total amount of additional water added during the second dishwashing cycle, and determining a second amount of water to deliver to the dishwasher for a third dishwashing cycle subsequent the second cycle using the retained first total amount of additional water added and the retained second total amount of additional water added.

In another aspect, a dishwasher is provided. The dishwasher includes a wash chamber, and a turbine ratemeter positioned to deliver water into the wash chamber.

In still another aspect, a dishwasher includes a wash chamber, means to deliver a metered amount of water into the wash chamber, and a controller coupled to the means. The controller is configured to deliver a first amount of water to the dishwasher for a first dishwashing cycle, monitor at least one operation of the dishwasher during the first dishwashing cycle to detect an underfill condition, and add additional water to the dishwasher upon detecting at least one underfill condition during the first dishwashing cycle. The controller is also configured to retain a first total amount of additional water added during the first dishwashing cycle, deliver the first amount of water to the dishwasher for a second dishwashing cycle subsequent the first cycle, and monitor at least one operation of the dishwasher during the second dishwashing cycle to detect an underfill condition. The controller is further configured to add additional water to the dishwasher upon detecting at least one underfill condition during the second dishwasher cycle, retain a second total amount of additional water added during the second dishwashing cycle, and determine a second amount of water to deliver to the dishwasher for a third dishwashing cycle subsequent the second cycle using the retained first total amount of additional water added and the retained second total amount of additional water added.

DETAILED DESCRIPTION OF THE INVENTION

Figure 1:
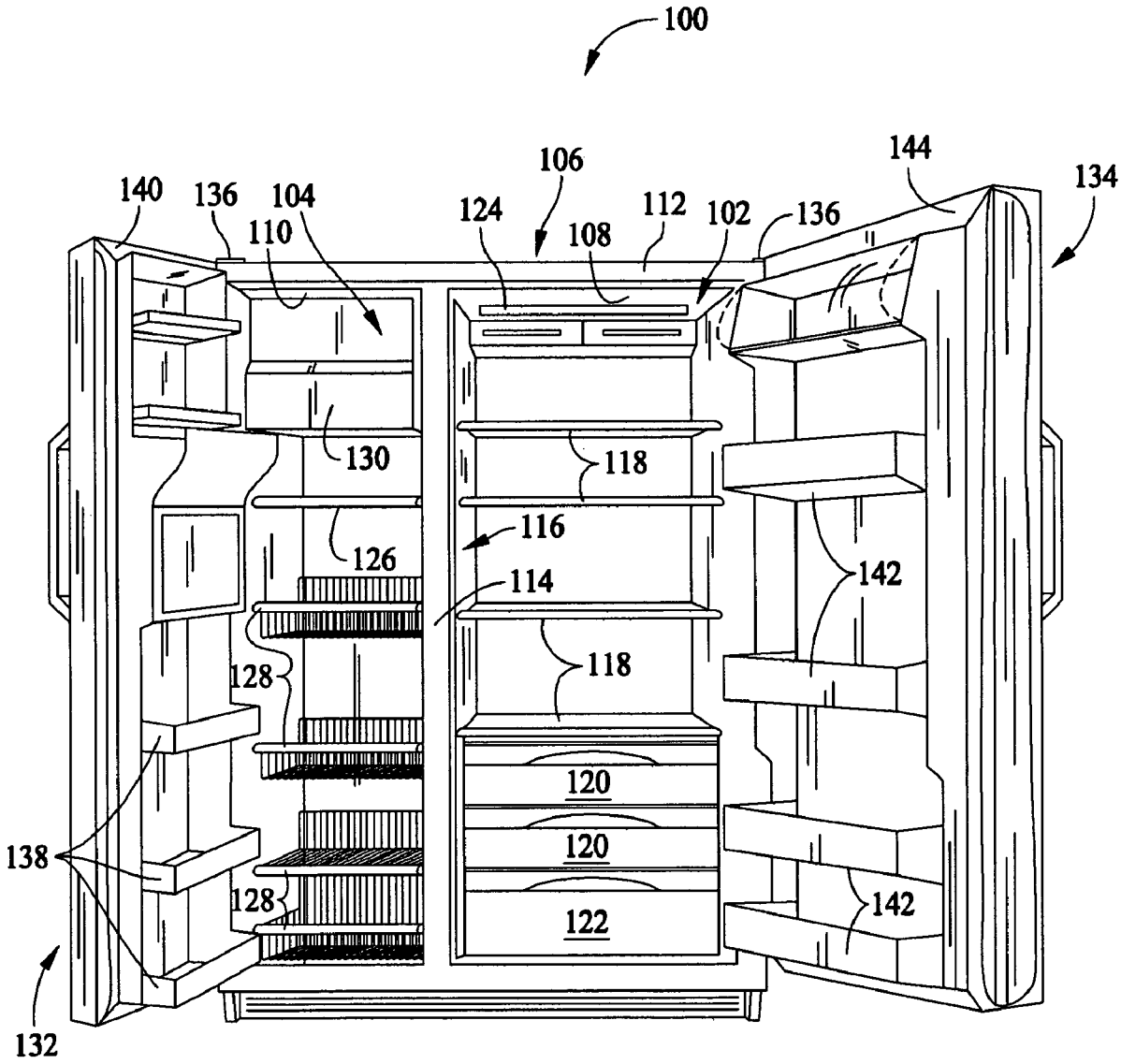
FIG. 1 illustrates a side-by-side refrigerator.

FIG. 1 illustrates an exemplary refrigerator 100. While the apparatus is described herein in the context of a specific refrigerator 100, it is contemplated that the herein described methods and apparatus may be practiced in other types of refrigerators. Therefore, as the benefits of the herein described methods and apparatus accrue generally to ice maker controls in a variety of refrigeration appliances and machines, the description herein is for exemplary purposes only and is not intended to limit practice of the invention to a particular refrigeration appliance or machine, such as refrigerator 100.

Refrigerator 100 includes a fresh food storage compartment 102 and freezer storage compartment 104. Freezer compartment 104 and fresh food compartment 102 are arranged side-by-side, however, the benefits of the herein described methods and apparatus accrue to other configurations such as, for example, top and bottom mount refrigerator-freezers. Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also, in one embodiment, is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 is positioned within compartment 102. A shelf 126 and wire baskets 128 are also provided in freezer compartment 104. In addition, an ice maker 130 is provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

Figure 2:
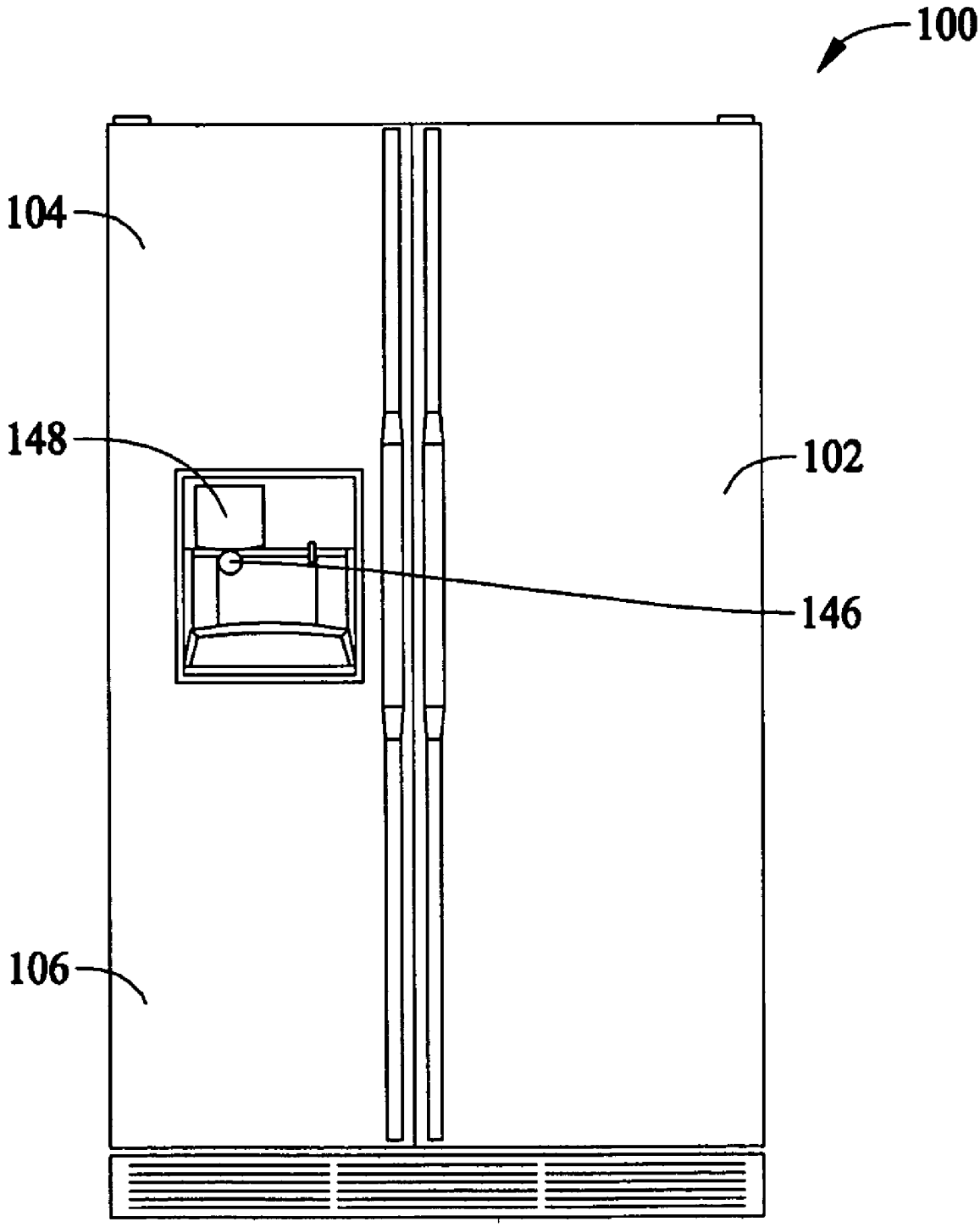
FIG. 2 is front view of the refrigerator of FIG. 1.

FIG. 2 is a front view of refrigerator 100 with doors 102 and 104 in a closed position. Freezer door 104 includes a through the door water dispenser 146, and a user interface 148.

In use, and as explained in greater detail below, a user enters a desired amount of water using interface 148, and the desired amount is dispensed by dispenser 146. For example, a recipe calls for certain amount of water (e.g., ⅓ cup, ½ cup, 1 tablespoon, 2 teaspoons, 6 ounces, etc.), and instead of using a measuring cup, the user can use any size container (large enough to hold the desired amount) by entering the desired amount using interface 148, and receiving the desired amount via dispenser 146.

Figure 3:
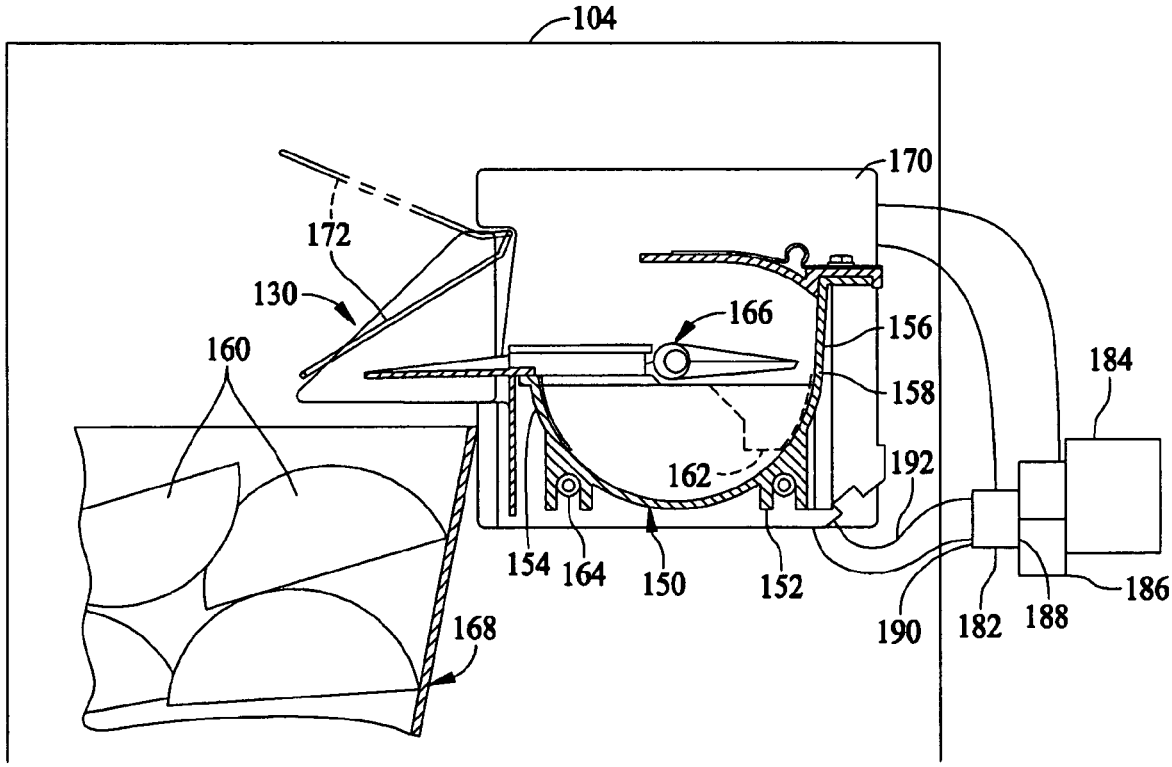
FIG. 3 is a cross sectional view of an exemplary ice maker in a freezer compartment.

FIG. 3 is a cross sectional view of ice maker 130 including a metal mold 150 with a tray structure having a bottom wall 152, a front wall 154, and a back wall 156. A plurality of partition walls 158 extend transversely across mold 150 to define cavities in which ice pieces 160 are formed. Each partition wall 158 includes a recessed upper edge portion 162 through which water flows successively through each cavity to fill mold 150 with water.

A sheathed electrical resistance ice removal heating element 164 is press-fit, staked, and/or clamped into bottom wall 152 of mold 150 and heats mold 150 when a harvest cycle is executed to slightly melt ice pieces 160 and release them from the mold cavities. A rotating rake 166 sweeps through mold 150 as ice is harvested and ejects ice from mold 150 into a storage bin 168 or ice bucket. Cyclical operation of heater 164 and rake 166 are effected by a controller 170 disposed on a forward end of mold 150, and controller 170 also automatically provides for refilling mold 150 with water for ice formation after ice is harvested through actuation of a water valve 182 connected to a water source 184 and delivering water to mold 150 through an inlet structure (not shown). A turbine ratemeter 186 is positioned in flow communication with valve 184. In one embodiment, ratemeter 186 is positioned proximate an inlet side 188 of valve 184 as shown in FIG. 3. In another embodiment, ratemeter 186 is positioned proximate a discharge side 190 of valve 184.

In order to sense a level of ice pieces 160 in storage bin 168, controller 170 actuates a spring loaded feeler arm 172 for controlling an automatic ice harvest so as to maintain a selected level of ice in storage bin 168. Feeler arm 172 is automatically raised and lowered during operation of ice maker 130 as ice is formed. Feeler arm 172 is spring biased to a lowered "home" position that is used to determine initiation of a harvest cycle and raised by a mechanism (not shown) as ice is harvested to clear ice entry into storage bin 138 and to prevent accumulation of ice above feeler arm 172 so that feeler arm 172 does not move ice out of storage bin 168 as feeler arm 172 raises. When ice obstructs feeler arm 172 from reaching its home position, controller 170 discontinues harvesting because storage bin 168 is sufficiently full. As ice is removed from storage bin 168, feeler arm 172 gradually moves to its home position, thereby indicating a need for more ice and causing controller 170 to initiate a fill operation as described in more detail below.

In another exemplary embodiment, a cam-driven feeler arm (not shown) rotates underneath ice maker 130 and out over storage bin 168 as ice is formed. Feeler arm 172 is spring biased to an outward or "home" position that is used to initiate an ice harvest cycle, and is rotated inward and underneath ice maker 130 by a cam slide mechanism (not shown) as ice is harvested from ice maker mold 150 so that the feeler arm does not obstruct ice from entering storage bin 168 and to prevent accumulation of ice above the feeler arm. After ice is harvested, the feeler arm is rotated outward from underneath ice maker 130, and when ice obstructs the feeler arm and prevents the feeler arm from reaching the home position, controller 170 discontinues harvesting because storage bin 168 is sufficiently full. As ice is removed from storage bin 168, feeler arm 172 gradually moves to its home position, thereby indicating a need for more ice and causing controller 170 to initiate to initiate a fill operation as described in more detail below.

In use, turbine ratemeter 186 generates a square wave signal that is supplied to controller 170. More specifically, during a fill operation, controller 170 opens valve 182, and receives a plurality of square waves (i.e., pulses) from ratemeter 186 representative of a quantity of water flow therethrough. When the number of received pulses reaches a predetermined number, controller 170 closes valve 182 to stop water flow through ratemeter 186 and valve 182. Because each pulse represents a specific quantity of water that flowed though ratemeter 186, each fill operation delivers the same amount of water regardless of water pressure. Additionally, in one embodiment, a user interface 192 is operationally coupled to controller 170, and the user is able to indicate a fill amount to increase or decrease the size of the ice cubes being made. The predetermined number of received pulses at which controller 170 closes valve 182 is selected based upon the user selected fill level.

In one embodiment, a capillary tube 192 is positioned between valve 182 and the ice maker inlet. Capillary tube 192 has an inner diameter (ID) between about 0.075 inches and about 0.175 inches, and a length between about 12 inches and about 60 inches. Capillary tube 192 slows the flow rate of water through valve 182 resulting in quieter fill operations than in embodiments without capillary tube 192 (e.g., with a tube the same size as supply tube 184). In an empirical study, the noise from fill operations was reduced from 45 decibels (Accoustic) dBA without capillary tube 192 (i.e., using a known self regulating flow washer) to 24 dBA with capillary tube 192. Because each pulse represents a specific quantity of water that flowed though ratemeter 186, each fill operation delivers the same amount of water regardless of tube size. Accordingly, ratemeter 186 and capillary tube 192 provide for low noise accurate fill operations.

In an exemplary embodiment, water supply 184, ratemeter 186, and valve 182 are utilized in conjunction with dispenser 146 which is in flow communication with valve 182. A user enters a desired amount of water using interface 148, and receives the desired amount via dispenser 146. More particularly, controller 170 opens valve 182 to allow water flow therethrough and through dispenser 146 in flow communication with valve 182. Controller 170 receives a plurality of pulses from ratemeter 186, wherein each pulse is representative of a quantity of water flow therethrough. Controller 170 then closes valve 182 upon receipt of a predetermined number of pulses. The predetermined number is based on the entered desired amount. For example, when the user enters ½ cup, valve 182 is closed after 400 pulses, and when the user enters 1 cup, valve 182 is closed after 800 pulses. Of course this example is for a ratemeter generating 800 pulses per cup (i.e., each pulse represents 1/800 cup). For ratemeters in which a pulse represents an amount different than 1/800 cup, the predetermined number of pulsed will be different.

While described in the context of a single controller controlling a fill operation for an ice maker and a dispense operation for a water dispenser, it is contemplated that different controllers may be used. Also, as used herein, the term controller is not limited to just those integrated circuits referred to in the art as controllers, but broadly refers to computers, processors, microcontrollers, microcomputers, programmable logic controllers, application specific integrated circuits, and other programmable circuits, such as, for example, field programmable gate arrays, and these terms are used interchangeably herein. Additionally, although described in the context of a single valve and a single ratemeter for both ice maker fill operations and water dispensing operations, other embodiments employ a separate valve and/or ratemeter for each operation.

Figure 4:
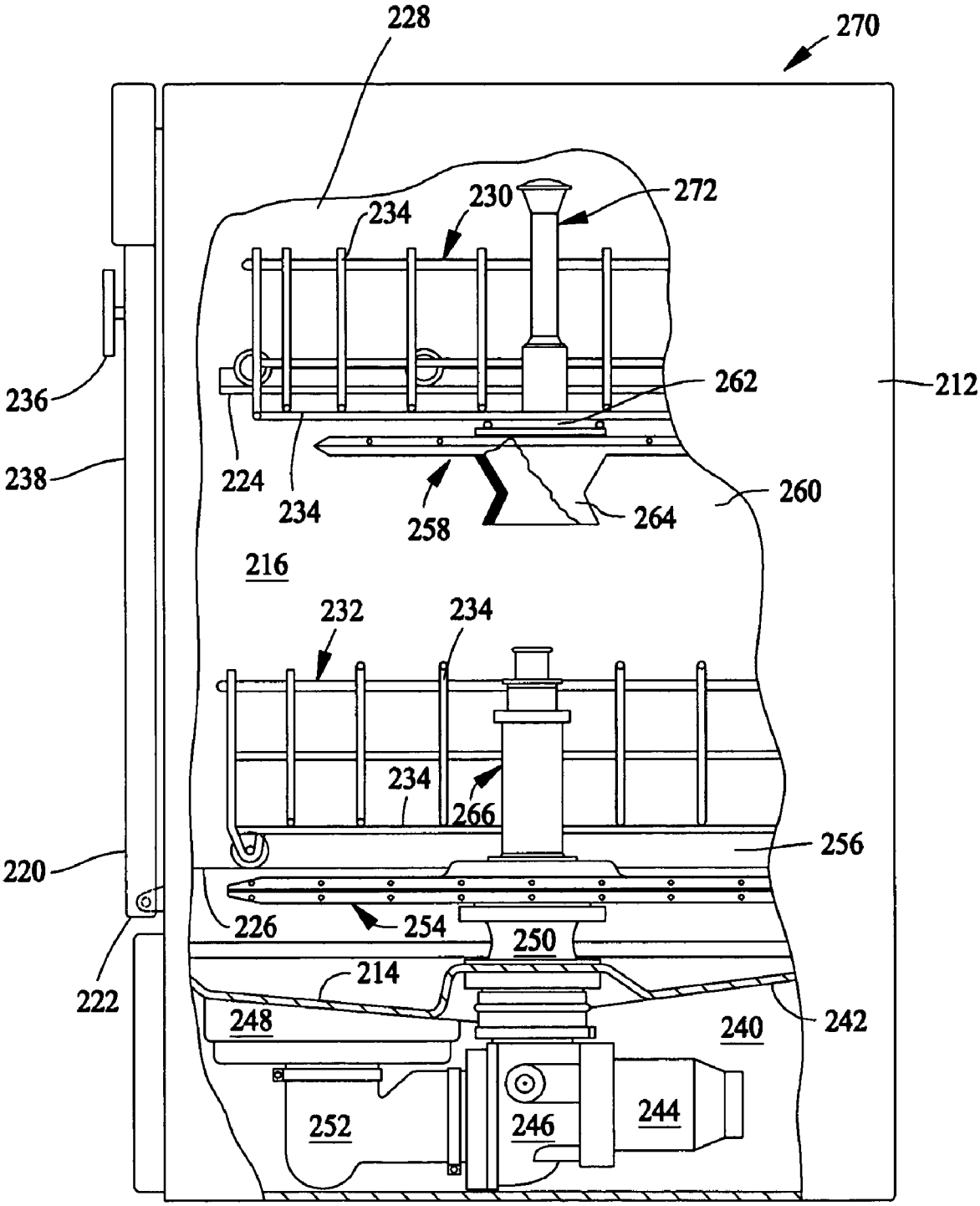
FIG. 4 is a side elevational view of an exemplary domestic dishwasher partially broken away.

FIG. 4 is a side elevational view of an exemplary domestic dishwasher 270 partially broken away, and in which the present invention may be practiced. It is contemplated, however, that the invention may be practiced in other types of dishwashers beyond the dishwasher 270 described and illustrated herein. Accordingly, the following description is for illustrative purposes only, and the invention is in no way limited to use in a particular type dishwasher, such as dishwasher 270. Additionally, while described in the context of a refrigerator and dishwasher, it is contemplated that the benefits of the invention accrue to all appliances, such as, for example, a refrigerator, a dishwasher, a washing machine, and a water dispenser.

Dishwasher 270 includes a cabinet 212 having a tub 214 therein and forming a wash chamber 216. Tub 214 includes a front opening (not shown) and a door 220 hinged at its bottom for movement between a normally closed vertical position (shown in FIG. 4) and a horizontal open position (not shown). Upper and lower guide rails 224, 226 are mounted on tub side walls 228 and accommodate upper and lower roller-equipped racks 230, 232, respectively. Each of upper and lower racks 230, 232 is fabricated from known materials into lattice structures including a plurality of elongate members 234, and each rack 230, 232 is adapted for movement between an extended loading position (not shown) in which the rack is substantially positioned outside wash chamber 216, and a retracted position (shown in FIG. 4) in which the rack is located inside wash chamber 216.

A control input selector 236 is mounted at a convenient location on an outer face 238 of door 220 and is coupled to control circuitry (not shown in FIG. 4) and control mechanisms (not shown) for operating dishwasher system components located in a machinery compartment 240 below a bottom 242 of tub 214. An electric motor 244 drivingly coupled to a pump 246 provides for circulation of water from a sump portion 248 of tub 214 to a water discharge pipe 250. An inlet pipe 252 connects sump 248 to an inlet (not shown) of pump 246, and pump 246 includes a discharge conduit (not shown) that communicates in flow relationship with a building plumbing system (not shown).

A lower spray-arm-assembly 254 is rotatably mounted within a lower region 256 of wash chamber 216 and above tub bottom 242 so as to rotate in relatively close proximity to lower rack 232. A mid-level spray-arm assembly 258 is located in an upper region 260 of wash chamber 216 and is rotatably attached to upper rack 230 in close proximity thereto and at a sufficient height above lower rack 232 to be above a largest item, such as a dish or platter (not shown), that is expected to be washed in dishwasher 270. Mid-level spray-arm assembly 258 includes a central hub 262 and a downwardly projecting funnel 264 for receiving a water stream through a retractable tower 266 of lower spray-arm assembly 254 without retractable tower 266 sealingly engaging mid-level spray-arm assembly 258. Mid-level spray-arm funnel 264 facilitates a degree of off-centering or misalignment of mid-level spray-arm 258 with respect to retractable tower 266 as water from retractable tower 266 impacts funnel 264. Thus, precise positioning of mid-level spray-arm 258 vis-à-vis retractable tower 266 is avoided. Retractable tower 266 is mounted to lower-spray-arm assembly 254 and therefore rotates with lower spray-arm assembly 254 as dishwasher 270 is used, thereby eliminating sealing problems in connections between retractable tower 266 and lower spray-arm assembly 254.

Both lower and mid-level spray-arm assemblies 254, 258 include an arrangement of discharge ports or orifices for directing washing liquid upwardly onto dishes located in upper and lower racks, respectively. The arrangement of the discharge ports provides a rotational force by virtue of washing fluid action through the discharge ports. The resultant rotation of the spray-arm provides coverage of dishes and other dishwasher contents with a washing spray.

Figure 5:
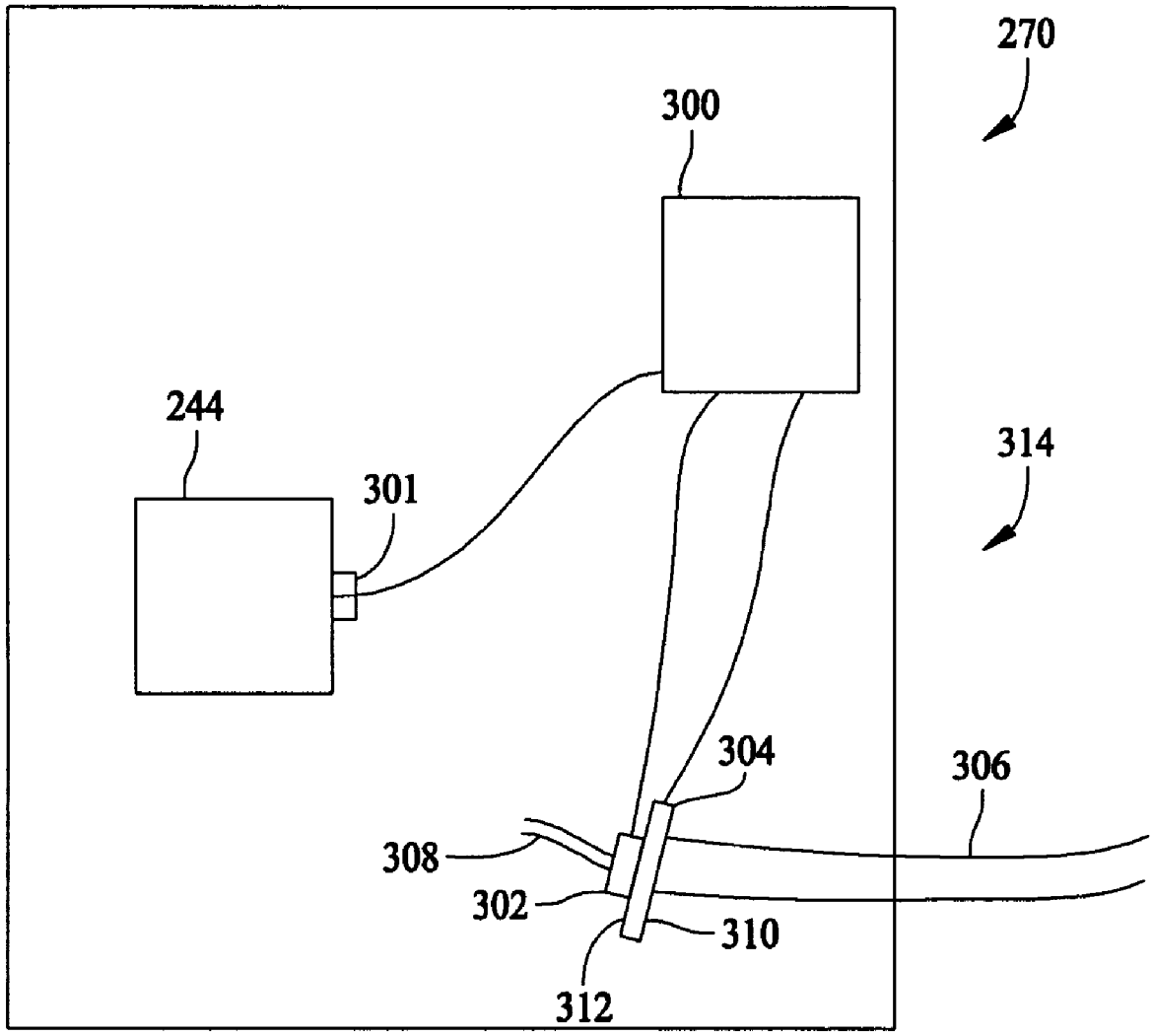
FIG. 5 illustrates a controller operationally coupled to the sump pump motor shown in FIG. 4.

FIG. 5 illustrates a controller 300 operationally coupled to sump pump motor 244 via a current sensor 301. Current sensor 301 senses current draw by motor 244 to allow for a detection of cavitation. In one embodiment, motor 244 is an alternating current (AC) motor and current sensor 301 measures a phase angle to allow for the detection of cavitation. Controller 300 is also coupled to a valve 302 and a turbine ratemeter 304. A water supply line 306 is in flow communication with valve 302. Water supply line 306 is a typical household supply line and is typically sized to have an inner diameter of ¼ inch (high pressure and high temperature rated plastic) or a ⅜ inch outer diameter (copper). A restrictor tube 308 is in flow communication with ratemeter 304 and has a diameter smaller than supply line 306. Restrictor tube 308 is similar to capillary tube 192 in that embodiments with restrictor tube 308 result in quieter operation than embodiments without restrictor tube 308.

Turbine ratemeter 304 is positioned in flow communication with valve 302. In one embodiment, ratemeter 304 is positioned proximate an inlet side 310 of valve 302 as shown in FIG. 5. In another embodiment, ratemeter 304 is positioned proximate a discharge side 312 of valve 302.

In use, turbine ratemeter 304 generates a square wave signal that is supplied to controller 300. More specifically, during a fill operation, controller 300 opens valve 302, and receives a plurality of square waves (i.e., pulses) from ratemeter 304 representative of a quantity of water flow therethrough. When the number of received pulses reaches a predetermined number, controller 300 closes valve 302 to stop water flow through ratemeter 304 and valve 302. Because each pulse represents a specific quantity of water that flowed though ratemeter 304, each fill operation delivers the same amount of water regardless of water pressure. Additionally, the amount of water delivered in a fill operation is adaptable as described below.

FIG. 5 illustrates a system 314 that creates a low noise fill for a dishwasher cycle while at the same time lessening the fill and therefore the energy and water used by dishwasher 270. System 314 is a closed loop system that adapts to the normal use requirement based on noise parameters such as installation levelness and water line pressure. System 314 also detects abnormal conditions such as a cup becoming over turned and filling up with water causing a pump cavitation in pump 246 and excessive noise as a result.

Controller 300 monitors and controls the fill into dishwasher 270 with a predetermined minimum amount of water using valve 302 and ratemeter 304. Pump 246 is then started and current sensor 301 is used to monitor the stability of the current to determine if pump 246 and/or any other part of the hydraulic system is primed. If the hydraulic system is not primed there can be pump cavitation and a fluctuation in the current being drawn by motor 244. If this fluctuation occurs, a signal is sent from controller 300 to valve 302 to open again, and the fill is adjusted until the pump cavitation stops. The total amount of additional fill is stored in a memory (not shown) of controller 300. Note, the total amount of additional fill can result from more than one detection of an underfill condition and valve 302 can be opened and closed a plurality of times during a single dishwasher cycle. If the same pattern occurs the next couple of times the dishwasher is run the initial fill is adjusted on a semi-permanent basis. In other words, after an installation, turbine ratemeter 304 is used to deliver a first amount of water to dishwasher 270 for a first dishwashing cycle. Controller 300 monitors at least one operation of dishwasher 270 during the first dishwashing cycle to detect an underfill condition (e.g., cavitation of pump 244), turbine ratemeter 304 is used to add additional water to dishwasher 270 upon controller 300 detecting at least one underfill condition during the first dishwashing cycle. A first total amount of additional water added during the first dishwashing cycle is retained in the memory of controller 300. Turbine ratemeter 304 is used to deliver the first amount of water to dishwasher 270 for a second dishwashing cycle subsequent the first cycle, and controller 300 monitors at least one operation of the dishwasher (such as, for example, pump cavitation) during the second dishwashing cycle to detect an underfill condition. Turbine ratemeter 304 is used to add additional water to the dishwasher upon detecting at least one underfill condition during the second dishwasher cycle, and a second total amount of additional water added during the second dishwashing cycle is retained in the memory. Based upon the first and second additional water added amounts, controller 300 determines a second amount of water to deliver to dishwasher 270 for a dishwashing cycle subsequent the second cycle. Accordingly, the amount of water used for the fill operation is adaptive for different installation variables, such as, for example, levelness of dishwasher 270. Of course, controller 300 can determine the second amount based on more than two cycles. In one example, an average of the first and second additional amounts is used to add to the first fill amount to obtain the second fill amount. In another example, the greater of the first and second additional amounts is summed with the first fill amount to obtain the second fill amount. Additionally, in one embodiment, the second amount is stored in volatile memory, and upon a loss of power to dishwasher 270, the above described adaptive process is repeated. Also, the second amount can be further adaptively updated. For example, controller 300 can be configured to measure any additional fill amounts every N cycles, and update the second amount accordingly.

Use of current sensor 301 eliminates a need for a flow washer and therefore eliminates the fill noise associated with systems that use flow washers. Additionally, known dishwashers that use flow washers suffer from the effects of pressure fluctuations in the supply line that can affect the amount of fill. However, the use of turbine ratemeter 302 to deliver a measured amount of water and the detection of pump cavitation to detect an underfill condition, allows for more accurate fill operations. Additionally, when a glass (or other container) is overturned and collects enough water to cause pump cavitation and excess noise, current sensor 301 of pump 244 signals controller 300 for more fill and controller 300 controls valve 304 and ratemeter 302 to add more water to the cycle. Alternatively, an indicator on control panel 236 signals that the load needed to be checked. In one embodiment, an audible signal is used to alert a user that a container has filled with water. In either embodiment (visual or audible indication), the signal may last for a predetermined time and upon controller 300 registering a lack of the user checking the load (e.g., an absence of door 220 being opened or a lack of the user pushing a button within a predetermined time period), controller 300 controls valve 304 and ratemeter 302 to add more water to the cycle, and stops the signal that indicated the check load request.

As used herein, an element or step recited in the singular and preceded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features. Exemplary embodiments are described above in detail. The assemblies and methods are not limited to the specific embodiments described herein, but rather, components of each assembly and/or method may be utilized independently and separately from other components described herein.

While the invention has been described in terms of various specific embodiments, those skilled in the art will recognize that the invention can be practiced with modification within the spirit and scope of the claims.

What is claimed is:

1. A dishwasher comprising:

a wash chamber;

a water supply line in flow communication with said wash chamber, said water supply line having a first diameter;

a valve configured to deliver water from said water supply line into said wash chamber;

a turbine ratemeter in flow communication with said valve, said turbine ratemeter configured to meter water flow through said valve and generate a signal comprising a plurality of square wave pulses representing a quantity of water flow through said valve, each pulse of said plurality of square wave pulses representing a unit quantity of water;

a restrictor tube in flow communication with said turbine ratemeter, said restrictor tube having a second diameter smaller than said first diameter; and a controller in signal communication with said turbine ratemeter, said controller configured to:

open said valve;

receive the generated signal from said turbine ratemeter;

close said valve when a predetermined number of pulses have been received from said turbine ratemeter such that a predetermined quantity of water is supplied through said valve; and vary the quantity of water for a next use of the dishwasher based on at least one prior water usage.

2. A dishwasher in accordance with claim 1 further comprising a pump motor configured to pump liquid into said wash chamber, said controller coupled to said motor, said controller configured to detect a cavitation of said pump and use said ratemeter to deliver a predetermined amount of water upon the detection.

3. A dishwasher in accordance with claim 2 wherein said controller is configured to detect a cavitation by sensing a current to said motor.

4. A dishwasher in accordance with claim 3 wherein said is controller configured to detect a cavitation by sensing a phase of an alternating current to said motor.

5. A dishwasher comprising:

a wash chamber;

a water supply line in flow communication with said wash chamber, said water supply line having a first diameter;

a valve and a turbine ratemeter positioned to deliver a metered amount of water into said wash chamber, said turbine ratemeter generating square wave pulses each representing a predetermined quantity of water;

a restrictor tube in flow communication with said turbine ratemeter, said restrictor tube having a second diameter smaller than said first diameter; and a controller coupled to said valve and said turbine ratemeter, said controller configured to:

deliver a first amount of water to the dishwasher for a first dishwashing cycle;

monitor at least one operation of the dishwasher during the first dishwashing cycle to detect an underfill condition;

add additional water to the dishwasher upon detecting at least one underfill condition during the first dishwashing cycle;

measure a first total amount of additional water by counting a first plurality of square wave pulses generated by said turbine ratemeter during addition of the additional water for the first dishwashing cycle;

retain the first total amount of additional water added during the first dishwashing cycle; and determine a second amount of water to deliver to the dishwasher for a cycle subsequent the at least one underfill condition based on the first amount of water and the first total amount of additional water.

6. A dishwasher in accordance with claim 5 further comprising a pump motor coupled to said controller, said controller further configured to monitor said pump to detect a pump cavitation.

7. A dishwasher in accordance with claim 6, wherein said controller is further configured to deliver a predetermined amount of water to said wash chamber upon a detecting the pump cavitation.

8. A dishwasher in accordance with claim 6, wherein said controller is further configured to provide an indication upon detecting the pump cavitation.

9. A dishwasher in accordance with claim 8, wherein said controller is further configured to provide a visual indication upon detecting the pump cavitation.

10. A dishwasher in accordance with claim 8, wherein said controller is further configured to provide an audible indication upon detecting the pump cavitation.

11. A dishwasher in accordance with claim 5, wherein said controller is further configured to:

after a power loss, deliver the first amount of water to the dishwasher for the first dishwashing cycle subsequent the power loss;

monitor at least one operation of the dishwasher during the first dishwashing cycle subsequent the power loss to detect the underfill condition;

add additional water to the dishwasher upon detecting at least one underfill condition during the first dishwashing cycle subsequent the power loss;

retain the first total amount of additional water added during the first dishwashing cycle subsequent the power loss; and vary the second amount of water to deliver to the dishwasher for a cycle subsequent the first dishwashing cycle subsequent the power loss based on the retained first total amount of additional water added and the first amount of water.

* * * * *